US007572967B2

(12) United States Patent
Meinl

(10) Patent No.: US 7,572,967 B2
(45) Date of Patent: Aug. 11, 2009

(54) CONGA DRUM STAND

(75) Inventor: Reinhold Meinl, Neustadt/Aisch (DE)

(73) Assignee: Roland Meinl Musikinstrumente GmbH & Co., Neustadt / Aisch (DE)

( * ) Notice: Subject to any disclaimer, the term of this patent is extended or adjusted under 35 U.S.C. 154(b) by 0 days.

(21) Appl. No.: 11/835,976

(22) Filed: Aug. 8, 2007

(65) Prior Publication Data

US 2008/0034945 A1 Feb. 14, 2008

(30) Foreign Application Priority Data

Aug. 8, 2006 (DE) ..... 20 2006 012 132 U

(51) Int. Cl.
*G10D 13/02* (2006.01)

(52) U.S. Cl. ..... 84/421; 248/443

(58) Field of Classification Search ..... 84/421; 248/443, 636, 638, 648; 267/136, 139, 140, 267/147, 258
See application file for complete search history.

(56) References Cited

U.S. PATENT DOCUMENTS 892,105 A * 6/1908 White ..... 248/60
1,022,149 A * 4/1912 Maphet ..... 84/421
1,837,637 A 12/1931 Walberg
2,202,319 A * 5/1940 Round ..... 152/226
2,245,883 A 6/1941 Walberg
2,534,137 A * 12/1950 Lewis ..... 428/169
2,929,434 A * 3/1960 Barnes ..... 72/319
3,173,642 A * 3/1965 Greenspan ..... 248/170
3,269,717 A * 8/1966 Beck ..... 267/141
3,405,587 A * 10/1968 Meazzi ..... 84/421
3,405,588 A * 10/1968 Della-Porta ..... 84/421
3,491,976 A * 1/1970 Larson ..... 248/346.11
3,504,900 A * 4/1970 Torr ..... 267/140
4,026,137 A * 5/1977 Scroggins ..... 72/299
4,601,598 A * 7/1986 Schwartz et al. ..... 401/6
4,781,365 A * 11/1988 Harrison ..... 267/294
5,024,425 A * 6/1991 Schwerdt ..... 267/140.12
5,076,132 A * 12/1991 Hsieh ..... 84/421
5,107,694 A * 4/1992 Kemp ..... 72/64
5,110,660 A * 5/1992 Wolf et al. ..... 428/178
5,138,902 A * 8/1992 Muller et al. ..... 74/574.4
5,180,147 A * 1/1993 Andersson et al. ..... 267/136
5,331,878 A * 7/1994 Kurosaki ..... 84/421
5,335,575 A * 8/1994 Hoshino ..... 84/421
5,366,198 A * 11/1994 Dickinson ..... 248/550
5,560,578 A * 10/1996 Schenken et al. ..... 248/313
5,918,300 A * 6/1999 Hsieh ..... 84/422.3
5,988,609 A * 11/1999 Young ..... 267/140

(Continued)

FOREIGN PATENT DOCUMENTS

DE 3118806 A1 12/1982

(Continued)

*Primary Examiner*—Jeffrey Donels
*Assistant Examiner*—Robert W Horn
(74) *Attorney, Agent, or Firm*—Browdy & Neimark, P.L.L.

(57) ABSTRACT

The invention relates to a conga drum stand comprising a supporting ring, away from which extend upwards at least three holding attachments having a concavely curved inside surface for receiving the conga drum and away from which extend downwards stand legs, in which the radius of curvature $R_1$ of the concavely curved inside of the holding attachments is greater than the radius of curvature $R_2$ of the supporting ring or of the conga drum to be received.

6 Claims, 3 Drawing Sheets

U.S. PATENT DOCUMENTS

| | | | | | |
|---|---|---|---|---|---|
| 5,996,959 | A * | 12/1999 | Gassen et al. | 248/635 |
| 6,040,514 | A * | 3/2000 | Liao | 84/421 |
| D428,302 | S * | 7/2000 | Miller | D7/396.1 |
| D431,423 | S * | 10/2000 | Ohm et al. | D7/620 |
| 6,330,903 | B1 * | 12/2001 | Weinreich | 160/295 |
| 6,343,891 | B1 * | 2/2002 | Combs | 403/391 |
| 6,357,717 | B1 * | 3/2002 | Kennard, IV | 248/638 |
| 6,416,029 | B1 * | 7/2002 | Holtermanns | 248/346.06 |
| 6,441,286 | B1 * | 8/2002 | Brando et al. | 84/411 R |
| 6,541,685 | B2 * | 4/2003 | Meinl | 84/421 |
| 6,612,085 | B2 * | 9/2003 | Edwards et al. | 52/649.1 |
| 6,667,432 | B2 * | 12/2003 | Brando | 84/411 R |
| 6,714,405 | B2 * | 3/2004 | Jitsukawa | 361/683 |
| 6,723,907 | B2 | 4/2004 | Sato | |
| 6,940,006 | B2 * | 9/2005 | Takegawa | 84/327 |
| 6,949,703 | B2 * | 9/2005 | Heubeck | 84/421 |
| 7,010,843 | B2 * | 3/2006 | Haneishi et al. | 29/451 |
| 7,205,469 | B2 * | 4/2007 | Chang | 84/421 |
| D549,820 | S * | 8/2007 | Hubler | D24/108 |
| 7,385,126 | B1 * | 6/2008 | Moghaddam | 84/421 |
| 7,394,009 | B2 * | 7/2008 | Judd | 84/421 |
| 2003/0221540 | A1 * | 12/2003 | Takegawa | 84/421 |
| 2004/0051021 | A1 * | 3/2004 | Micheel | 248/346.01 |
| 2004/0178550 | A1 * | 9/2004 | Donovan | 267/136 |
| 2006/0091281 | A1 * | 5/2006 | Miyahara et al. | 248/636 |
| 2006/0185496 | A1 * | 8/2006 | Wening et al. | 84/421 |
| 2006/0231713 | A1 * | 10/2006 | Crain et al. | 248/309.1 |
| 2007/0290422 | A1 * | 12/2007 | Akashi | 267/136 |
| 2008/0034945 | A1 * | 2/2008 | Meinl | 84/421 |

FOREIGN PATENT DOCUMENTS

| | | | |
|---|---|---|---|
| DE | 4006484 | A1 | 9/1991 |
| DE | 9206877 | U1 | 7/1992 |
| DE | 295005408 | U1 | 4/1995 |
| GB | 1154508 | | 6/1969 |
| WO | 0043983 | A1 | 7/2000 |

* cited by examiner

CONGA DRUM STAND

BACKGROUND OF THE INVENTION

1. Field of the Invention

The invention relates to a conga drum stand, comprising a supporting ring, away from which extend upwards at least three holding attachments having a concavely curved inner surface for receiving the conga drum and away from which extend downwards stand legs.

2. Background Art

A conga drum stand of this type is known, for example, from DE 10 2004 063 371 A1.

SUMMARY OF THE INVENTION

Based on a known conga drum stand of this type, the object of the invention is to further increase the stability of the arrangement consisting of conga drum stand and conga drum inserted therein during storage, but in particular when the conga drum is being played.

This object is achieved on the one hand in that the radius of curvature of the concavely curved inside of the holding attachments is smaller than the radius of curvature of the supporting ring or of the conga drum to be received.

The configuration according to the invention means that the conga drum does not rest in a planar manner on the inside of the holding attachments, but respectively along two defined lines, thereby greatly improving the press fit of the conga drum in the stand, which results in increased stability.

The holding attachments may be formed by rubber or plastics material elements positioned on a flat band metal material.

The holding attachments are preferably configured as an extension of the respective stand leg which is screwed to the supporting ring.

Another measure to increase stability if the stand legs are made of a planar profile material is that according to the invention, the profile material of the stand legs has an approximately 180° twist in the region upstream of the lower end. This has the further advantage that a visual effect is provided which imparts individuality to the respective conga drum stand and is also an indication of its origin.

The very bottom of the ends of the stand legs may align with the lower portion of the stand legs or may be offset therefrom by an obtuse angle.

The invention will be described in more detail hereinafter with reference to a preferred embodiment in conjunction with the drawings.

DESCRIPTION OF THE PREFERRED EMBODIMENT

Figure 1:
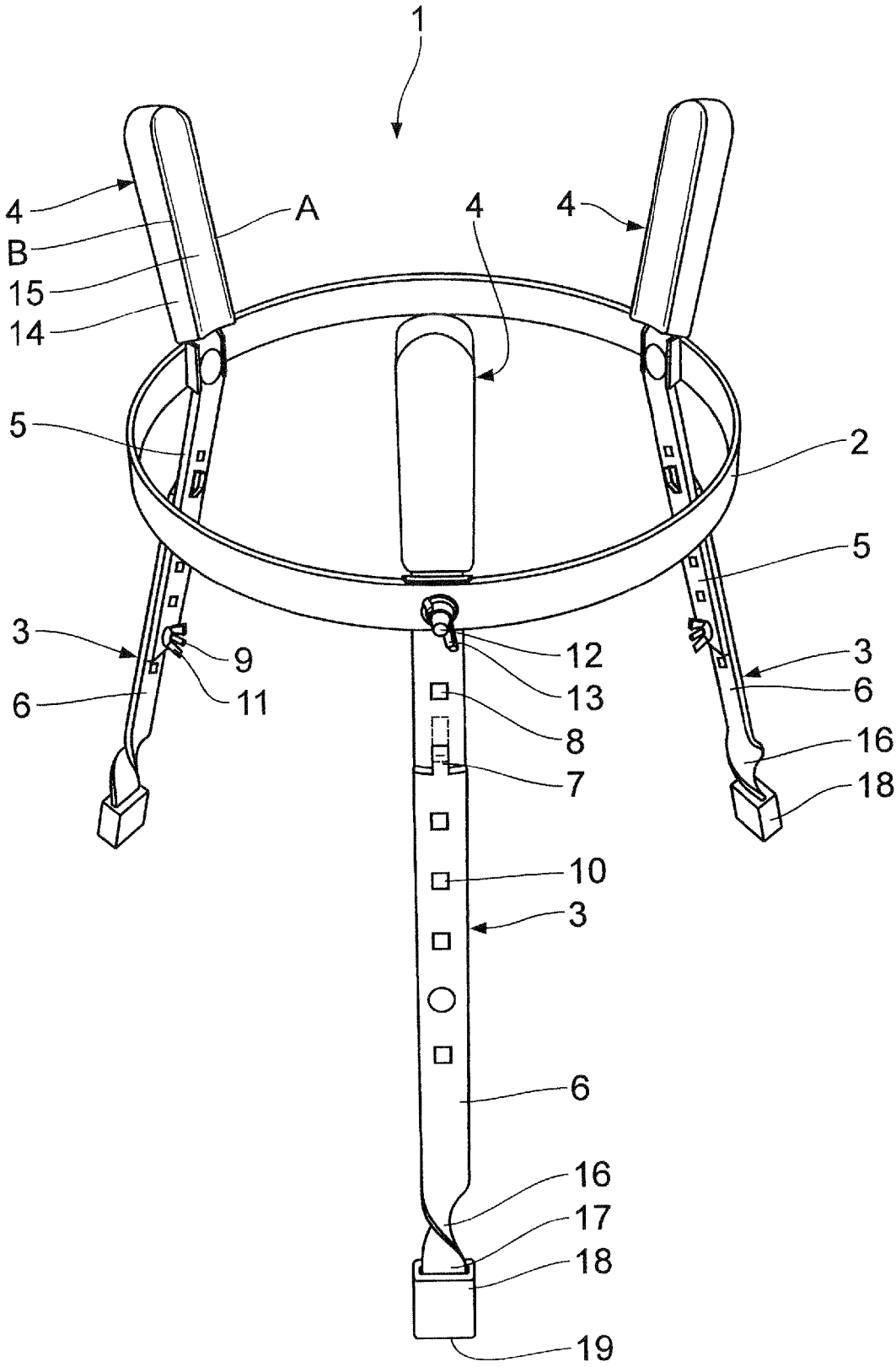
FIG. 1 shows a perspective view of a first embodiment as a conga drum stand according to the invention.

A conga drum stand 1 shown in the drawings comprises a supporting ring 2, to which are attached three legs 3 and three holding attachments 4. Each leg 3 comprises an upper portion 5 and a lower portion 6 made of a flat steel. Each of the lower portions 6 is provided on its upper surface with a hook 7 which may be inserted into corresponding recesses 8 in the upper portions 5 for height adjustment, it being possible to secure the position thus adjusted by a locking screw 9 which is inserted through recesses 10 in the lower portion 6 and through recesses 8 positioned thereunder in the upper portion 5 and secured by a wing nut 11.

The upper portions 5 have holes (not visible in the drawing) through which a fastening screw 12 is inserted which may be secured in each case by a wing nut 13.

Figure 3:
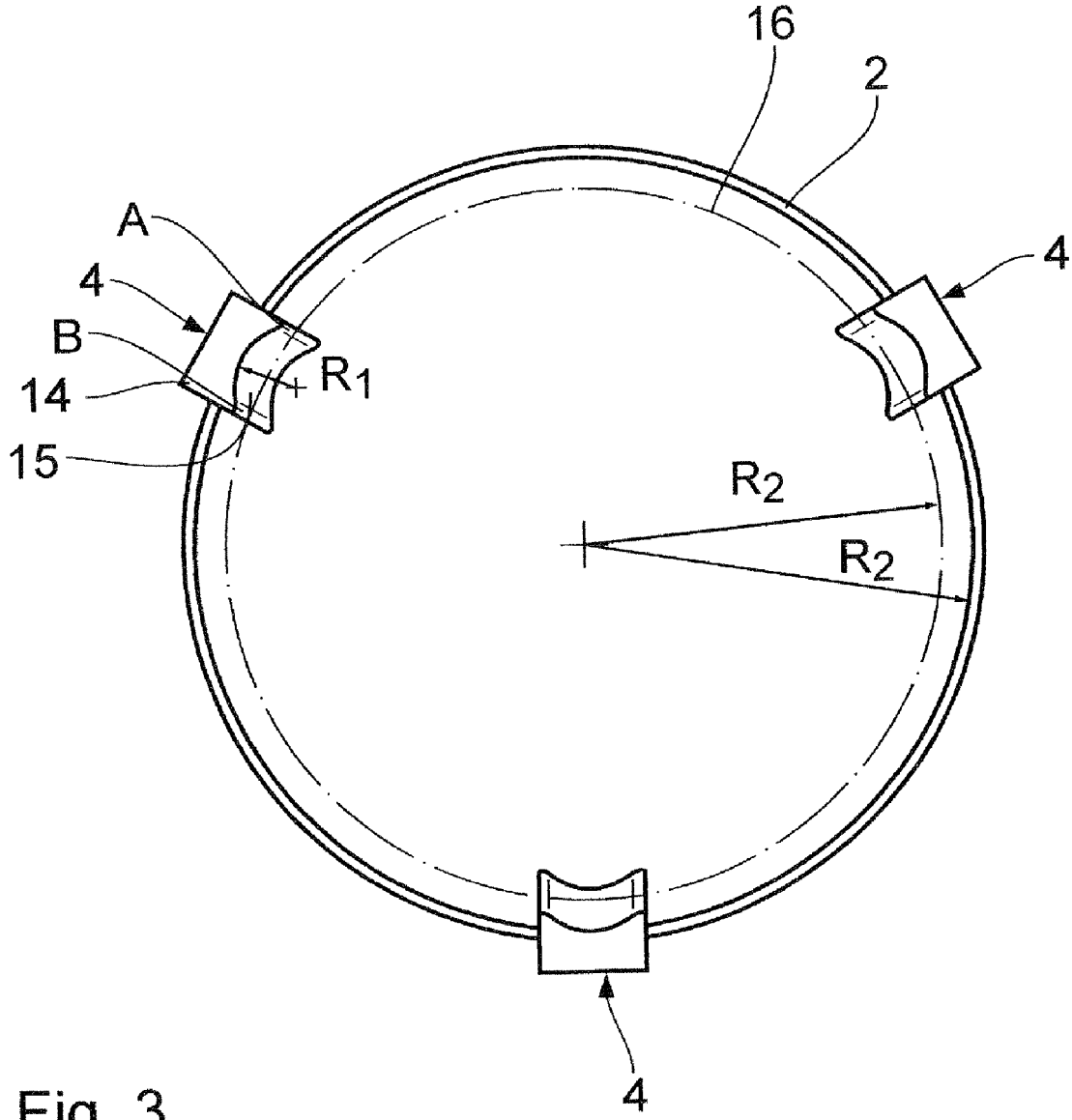
FIG. 3 shows a view from above of the conga drum stand according to FIG. 1 or FIG. 2.

The holding attachments 4 are integral with the upper portions 5 of the stand legs 3. Whereas the legs 3 extend outwardly in a downwards direction starting from the supporting ring 2, the holding attachments 4 are oriented outwardly in an upwards direction. The holding attachments 4 are each covered with a plastics material block 14 which, on the inside, has a concave contact surface 15. The radius of curvature $R_1$ of the contact surface 15 is less than the radius of curvature $R_2$ of the supporting ring 2 or of a conga drum 16 which is inserted into the supporting ring 2 and rests against the contact surfaces 15 and is indicated only in dashed lines in FIG. 3. Consequently, the lagging of the conga drum 16 does not rest in a planar manner against the holding surface 15, but only along the lines A and B, which results in linear and thus in relatively close contact, in particular also while bearing in mind irregularities in the surface of the conga drum.

The lower end 16 of the lower portions 6 of the stand legs 3 is twisted per se through 180° which increases the stability in the foot region.

Figure 2:
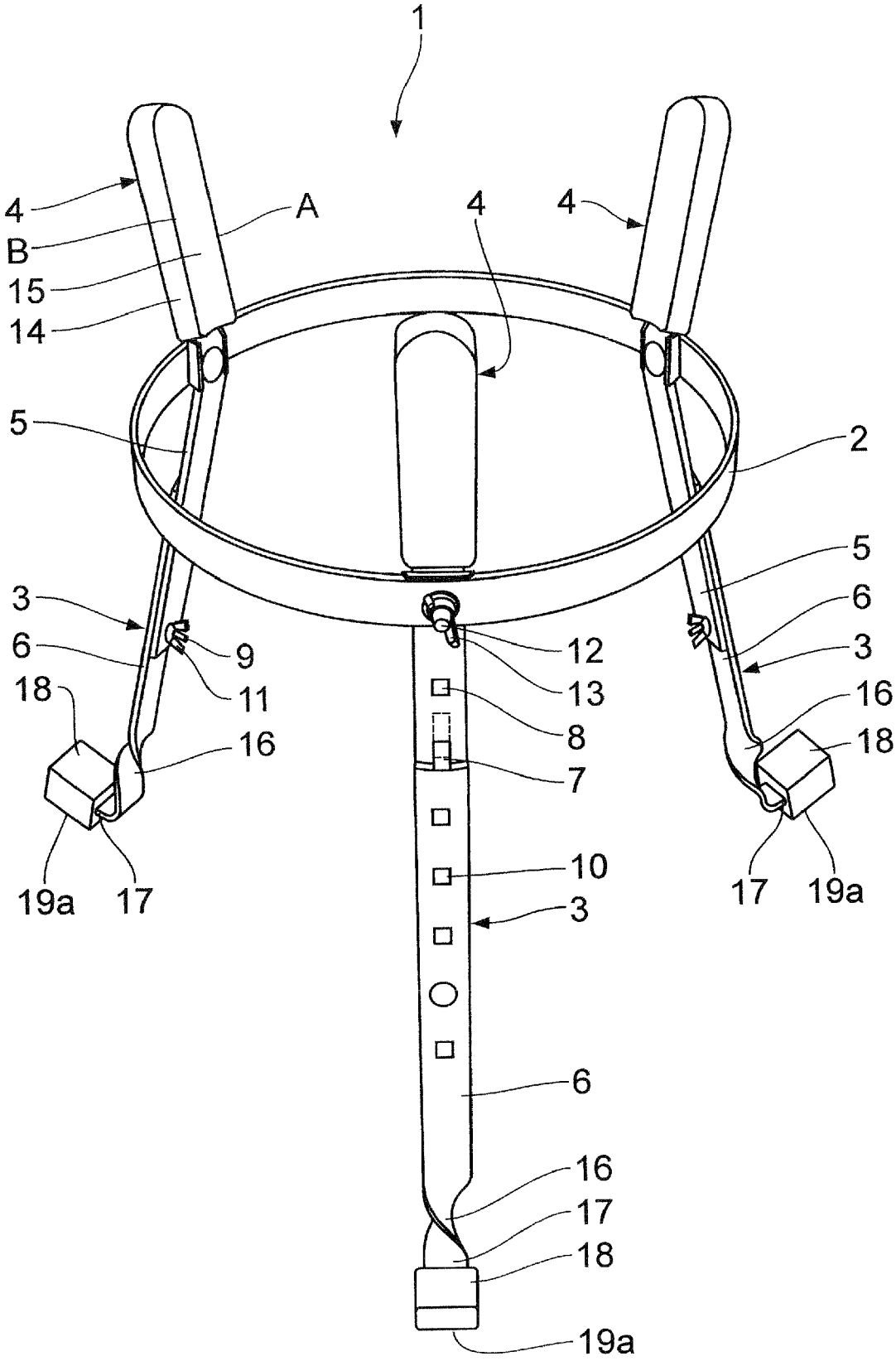
FIG. 2 shows a view, corresponding to FIG. 1, of a second embodiment.

In the embodiment according to FIG. 1, the non-twisted portion 17 of the lower end aligns with the portion 6, while the embodiment according to FIG. 2 provides an angular bend of 90°.

Pushed onto the lower region of this portion 17 are plastics material or rubber slip stoppers 18 which have on their lower side 19 and 19*a* respectively a non-slip structure in the form of rib-like or knob-like projections.

What is claimed is:

1. Conga drum stand comprising a horizontal supporting ring, away from which supporting ring (2) extends upwards at least three holding attachments (4) for jointly receiving a conga drum, each holding attachment (4) having an inside surface (15) which is concavely curved in a horizontal direction with a first radius of curvature ($R_1$), and away from which supporting ring (2) extend downwards stand legs (3), wherein the first radius of curvature ($R_1$) of the concavely curved inside surface (15) of the holding attachments (4) is substantially smaller than a second horizontal oriented radius ($R_2$) of the conga drum (16) to be received by the holding attachments (4), such that the conga drum will rest along two defined lines (A,B) against each holding attachment (4).

2. Conga drum stand according to claim 1, wherein the holding attachments (4) are formed by rubber or plastics material elements.

3. Conga drum stand according to claim 1, wherein the holding attachments (4) are configured as an extension of the respective stand leg (3) which is screwed to the supporting ring (2).

4. Conga drum stand according to claim 1, wherein the stand legs (3) consist of a planar profile material, wherein the profile material of the stand legs (3) have a twist (16) in the region upstream of the lower end (17).

5. Conga drum stand according to claim 4, wherein the twist (16) is of 180°.

6. Conga drum stand according to claim 4, wherein the lower ends (17) of the stand legs (3) are offset by an obtuse angle.

* * * * *